US008740214B2

(12) United States Patent
Onodera et al.

(10) Patent No.: US 8,740,214 B2
(45) Date of Patent: Jun. 3, 2014

(54) SHEET FEEDING APPARATUS AND IMAGE FORMING APPARATUS

(75) Inventors: Shinichi Onodera, Tokyo (JP); Yuya Yokobori, Kashiwa (JP); Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/361,013

(22) Filed: Jan. 30, 2012

(65) Prior Publication Data

US 2012/0205856 A1 Aug. 16, 2012

(30) Foreign Application Priority Data

Feb. 10, 2011 (JP) ..... 2011-026763

(51) Int. Cl.
*B65H 3/12* (2006.01)

(52) U.S. Cl.
USPC ..... 271/94; 271/98

(58) Field of Classification Search
USPC ..... 271/3.21, 3.22, 3.23, 5, 4.05, 11, 12, 271/10.06, 90, 93, 94, 96, 112, 113, 275, 271/276, 265.01
See application file for complete search history.

(56) References Cited

U.S. PATENT DOCUMENTS 4,699,369 A * 10/1987 Zirilli ..... 271/94
5,239,347 A 8/1993 Onodera et al.
5,933,697 A 8/1999 Onodera et al.
7,591,459 B2 9/2009 Matsumoto et al.
7,635,125 B2 12/2009 Ikeda
7,744,081 B2 6/2010 Ikeda
7,753,358 B2 7/2010 Ikeda
8,083,223 B2 12/2011 Ikeda
2007/0228640 A1* 10/2007 Ikeda ..... 271/98
2008/0251337 A1 10/2008 Itabashi et al.
2010/0181716 A1* 7/2010 Suzuki ..... 271/12
2010/0194031 A1 8/2010 Ikeda et al.
2011/0006474 A1 1/2011 Ikeda

FOREIGN PATENT DOCUMENTS

JP 7-97092 A 4/1995
JP 2007-276910 A 10/2007

* cited by examiner

*Primary Examiner* — Thomas Morrison
(74) *Attorney, Agent, or Firm* — Fitzpatrick, Cella, Harper & Scinto

(57) ABSTRACT

A sheet guiding rib protrudes below a sheet suction surface of a plurality of suction conveyer belts, the sheet guiding rib being provided at a position on a downstream side in a sheet conveying direction of a sheet suction region, in which a sheet can be sucked, of the sheet suction surface of the plurality of suction conveyer belts, and between the plurality of suction conveyer belts. At a time of conveying a topmost sheet sucked and deflected downward at a part of pressing a sheet surface detecting flag, a deflection amount of the topmost sheet is reduced by bringing the deflected part of the topmost sheet into abutment against the sheet guiding rib.

4 Claims, 9 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to a sheet feeding apparatus and an image forming apparatus in which sheets are separately fed by blowing air to the sheets.

2. Description of the Related Art

Conventionally, in image forming apparatus such as a copying machine and a printer in which an electrophotographic technology is employed, a toner image is formed on an image bearing member such as a photosensitive drum provided in an image forming portion, and the toner image is transferred onto a sheet. After that, the transferred toner image is fixed to the sheet by a fixing unit. Such an image forming apparatus includes a sheet storage portion which stores sheets and a sheet feeding apparatus which feeds one by one the sheets stored in the sheet storage portion. After being fed by the sheet feeding apparatus, the sheets are conveyed to the image forming portion.

By the way, in some conventional sheet feeding apparatus, air is blown to a sheet bundle stacked on a tray in the sheet storage portion so as to blow upper sheets of the sheet bundle upwards. In this way, the upper sheets are loosened one by one and sucked onto and conveyed by a suction conveyer belt. Note that, in a sheet feeding apparatus of such an air feeding type, in order to reliably suck the sheet by the suction conveyer belt, it is necessary to maintain a position of a topmost sheet, which is loosened by being blown upward by the air, to a predetermined level. Thus, a sheet surface detecting unit which detects the position of the topmost sheet is provided so that the position of the topmost sheet is maintained within a certain range through raising/lowering control on the tray and adjustment of airflow based on a detection result of the sheet surface detecting unit.

In this context, many of the sheet surface detecting units include a sheet surface detecting member to come into contact with an upper surface of the topmost sheet. By a detection sensor detecting a position of the sheet surface detecting member, the position of the topmost sheet is detected. Further, as described in U.S. Pat. No. 7,744,081, in some conventional sheet feeding apparatus, a plurality of suction conveyer belts are arranged in parallel with each other, and the sheet surface detecting member can be stored in an internal space between the suction conveyer belts. In this way, an image forming apparatus is downsized.

FIGS. 7A and 7B illustrate an example of the conventional sheet feeding apparatus of the air feeding type as described above. As illustrated in FIG. 7A, the conventional sheet feeding apparatus includes an air blowing portion 70 which blows air in a direction indicated by the arrow 69 so as to blow upward and loosen upper sheets of a sheet bundle PA stacked on a tray (not shown). Further, the sheet feeding apparatus includes a suction conveyance portion 50 which sucks and conveys the sheet thus blown upward, which suction conveyance portion 50 is arranged above the sheet bundle PA, and an intermediate conveyance portion 71 which conveys the sheet sucked and conveyed by the suction conveyance portion 50. The intermediate conveyance portion 71 includes intermediate guides 72 and 73 which guide the sheet and a pull-out roller pair 74 which conveys the sheet.

The suction conveyance portion 50 includes two endless suction conveyer belts 53*a* and 53*b* which are arranged parallel with each other and looped around pulleys 51*a* and 52*a* and travel in a direction indicated by the arrow 60. Further, the suction conveyance portion 50 includes a suction duct 54 which sucks a sheet P with a negative pressure through an opening portion thereof facing the sheets P, and which is arranged inside the suction conveyer belts 53*a* and 53*b*. Still further, the suction conveyance portion 50 includes a sheet surface detecting flag 58, which is supported by links 55 and 56 between the two suction conveyer belts 53*a* and 53*b* and is storable in a storage portion 57 provided in the suction duct 54 as illustrated in FIG. 7B. Yet further, a detection sensor S to be turned ON and OFF according to a turning position of the link 56 is arranged on an upstream side in a sheet conveying direction of the suction conveyer belts 53*a* and 53*b*.

In the sheet feeding apparatus structured as described above, at the time of feeding a sheet, when the upper sheets of the sheet bundle are blown upward by airflow from the air blowing portion 70, a level of a sheet surface of a topmost sheet P1 of the upper sheets thus blown upward of the sheet bundle is detected based on a position of the sheet surface detecting flag 58. Based on the detection results, raising/lowering control is performed on the tray such that the level of the upper surface of the topmost sheet P1 falls within a predetermined sheet surface level range in which the topmost sheet P1 can be sucked onto the suction conveyer belts 53*a* and 53*b*. After the topmost sheet P1 has been positioned within the predetermined sheet surface level range, the inside of the suction duct 54 is brought into a negative-pressure state by a negative pressure providing unit (not shown). In this way, the topmost sheet P1 at a predetermined sheet surface level is sucked toward a sheet suction surface of the suction conveyer belts 53*a* and 53*b*.

By the way, when the topmost sheet P1 is sucked toward the suction conveyer belts as described above, the sheet surface detecting flag 58 is stored into the storage portion 57 provided in the suction duct 54 as illustrated in FIG. 8 by a negative pressure provided by the negative pressure providing unit and by the topmost sheet P1 moving upward. In this way, the topmost sheet P1 is sucked onto the sheet suction surface of the suction conveyer belts 53*a* and 53*b*. Next, when the suction conveyer belts 53*a* and 53*b* is moved in the direction indicated by the arrow 60 in the state in which the topmost sheet P1 is sucked to the sheet suction surface, the topmost sheet P1 is conveyed integrally with the suction conveyer belts 53*a* and 53*b*.

Then, the topmost sheet P1 conveyed by the suction conveyer belts 53*a* and 53*b* is guided along the intermediate guides 72 and 73. When a leading edge of the topmost sheet P1 reaches the pull-out roller pair 74 of the intermediate conveyance portion 71, the negative-pressure state in the suction duct 54, which is caused by the negative pressure providing unit, is cancelled. After that, rotation of the suction conveyer belts 53*a* and 53*b* is stopped, and the topmost sheet P1 is pulled out by the pull-out roller pair 74.

Then, the topmost sheet P1 thus pulled out of the suction conveyance portion 50 by the pull-out roller pair 74 is conveyed to the image forming portion. Subsequently, by repeating the same operation, the stacked sheets P are sequentially fed one by one to the image forming portion.

By the way, in the conventional sheet feeding apparatus of the air feeding type as described above, a blown-upward level of the sheet under the sheet surface control may be different between a part of the topmost sheet P1 against which the sheet surface detecting flag 58 is in abutment and a part of the topmost sheet P1 against which the sheet surface detecting flag 58 is out of abutment because the blown-upward condition is different. Specifically, at the part of the topmost sheet P1 against which the sheet surface detecting flag 58 is in abutment, the topmost sheet P1 is pressed from above, for example, by the weight of the sheet surface detecting flag 58, and hence the blown-upward level decreases. Such tendency is prominent especially when the sheet to be sucked and conveyed has low rigidity. For example, when the sheet is a thin sheet having low rigidity, as illustrated in FIG. 9A, a sheet surface level of the part of the topmost sheet P1 against which the sheet surface detecting flag 58 is out of abutment is higher than a sheet surface level of the part thereof against which the sheet surface detecting flag 58 is in abutment, and enters a blown-upward state in which the part of the sheet lifted by blown air is close to the suction conveyer belts 53*a* and 53*b*.

When the topmost sheet P1 is sucked in such a blown-upward state, the part of the topmost sheet P1 against which the sheet surface detecting flag 58 is out of abutment and which is closer to the suction conveyer belts 53*a* and 53*b* reaches the suction surface earlier. As a result, as illustrated in FIG. 9B, the topmost sheet P1 is sucked onto the suction conveyer belts 53*a* and 53*b* in a state in which the part of the topmost sheet P1 against which the sheet surface detecting flag 58 is in abutment is deflected downward.

When the topmost sheet P1 is conveyed in such a state, as illustrated in FIG. 9C, a part T of the topmost sheet P1 which is deflected downward may collide against an inlet portion of the intermediate guide 73. As a result, the leading edge of the sheet may be damaged, or sheet jamming may occur. Further, the deflected part may be wrinkled at the time of passing a guide portion and a conveying roller pair on a downstream side in the sheet conveying direction.

SUMMARY OF THE INVENTION

The present invention has been made in view of the above-mentioned circumstance, and it is an object of the present invention to provide a sheet feeding apparatus and an image forming apparatus which feeds sheets without causing jamming or wrinkles.

The present invention provides a sheet feeding apparatus, including: a raising and lowering tray which supports sheets; an air blowing portion which blows air to the sheets supported by the tray to blow the sheets upwards; a plurality of suction conveyer belts which are arranged in parallel with each other and in parallel with a sheet conveying direction, and which suck, with a negative pressure, a sheet lifted by the air blown by the air blowing portion and convey the sheet; a sheet surface level detecting member which is arranged between the plurality of suction conveyer belts so as to come into abutment against a topmost sheet of the sheets supported by the tray, the sheet surface level detecting member being movable downward and in and out of a sheet suction surface of the plurality of suction conveyer belts, the sheet surface level detecting member being movable to a position at which the sheet surface level detecting member does not protrude below the sheet suction surface of the plurality of suction conveyer belts when being pressed by the sheet sucked by the plurality of suction conveyer belts; and a sheet guiding member provided so as to protrude below the sheet suction surface of the plurality of suction conveyer belts, the sheet guiding member being provided on a downstream side in the sheet conveying direction of a sheet suction region of the sheet suction surface of the plurality of suction conveyer belts and between the plurality of suction conveyer belts.

Further features of the present invention will become apparent from the following description of exemplary embodiments with reference to the attached drawings.

DESCRIPTION OF THE EMBODIMENTS

Figure 1:
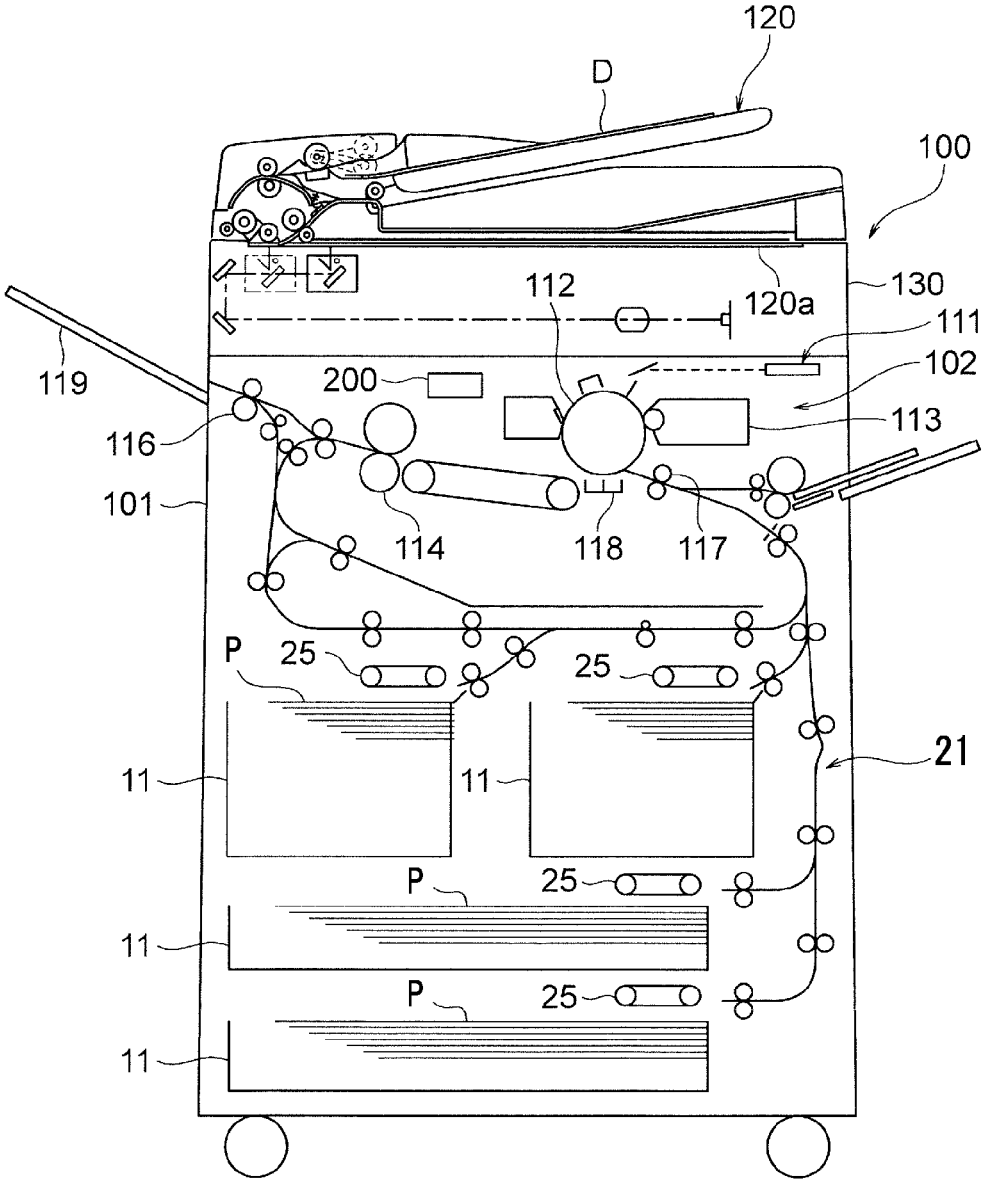
FIG. 1 is a schematic view of a structure of a printer as an example of an image forming apparatus including a sheet feeding apparatus according to an embodiment of the present invention.

In the following, an embodiment of the present invention will be described in detail with reference to the drawings. FIG. 1 is a schematic view of a structure of a printer as an example of an image forming apparatus including a sheet feeding apparatus according to the embodiment of the present invention.

FIG. 1 illustrates a printer 100 and a printer main body 101. In an upper portion of the printer main body 101, there is provided an image reading portion 130 which reads an original D placed on a platen glass 120*a* serving as an original placement table by an automatic original feeder 120. Further, below the image reading portion 130, there are provided an image forming portion 102, and a sheet feeding apparatus 21 which feeds sheets P to the image forming portion 102.

In this context, the image forming portion 102 includes a photosensitive drum 112, a developing device 113, and a laser scanner unit 111. Further, the sheet feeding apparatus 21 includes a plurality of sheet storage portions 11 which stores the sheets P such as an OHT sheet, the plurality of sheet storage portions 11 being detachably mounted in the printer main body 101, and suction conveyer belts 25 each serving as an example of a sheet feeding unit which feeds the sheets P stored in each of the sheet storage portions 11.

Next, an image forming operation of the printer 100 structured as described above will be described. When an image reading signal is output to the image reading portion 130 from a control device (not shown) provided in the printer main body 101, an image is read by the image reading portion 130. After that, the laser scanner unit 111 emits a laser beam corresponding to this electric signal, onto the photosensitive drum 112. At this time, the photosensitive drum 112 has already been charged in advance, and an electrostatic latent image is formed by irradiating the photosensitive drum 112 with the laser beam. Then, the electrostatic latent image is developed by the developing device 113. In this way, a toner image is formed on the photosensitive drum 112.

Meanwhile, when a sheet feeding signal is output from the control device to the sheet feeding apparatus 21, the sheet P is fed from the sheet storage portion 11. After that, the fed sheet P is conveyed by a registration roller pair 117 to a transfer portion formed between the photosensitive drum 112 and a transfer charger 118 in synchronization with the toner image on the photosensitive drum 112.

Next, the sheet P thus conveyed to the transfer portion undergoes transfer of the toner image, and then is conveyed to a fixing portion 114. After that, through heating and pressurizing by the fixing portion 114, the transferred unfixed image is permanently fixed onto the sheet P. Then, a delivery roller pair 116 delivers the sheet P having undergone such image fixation from the printer main body 101 onto a delivery tray 119.

Figure 2:
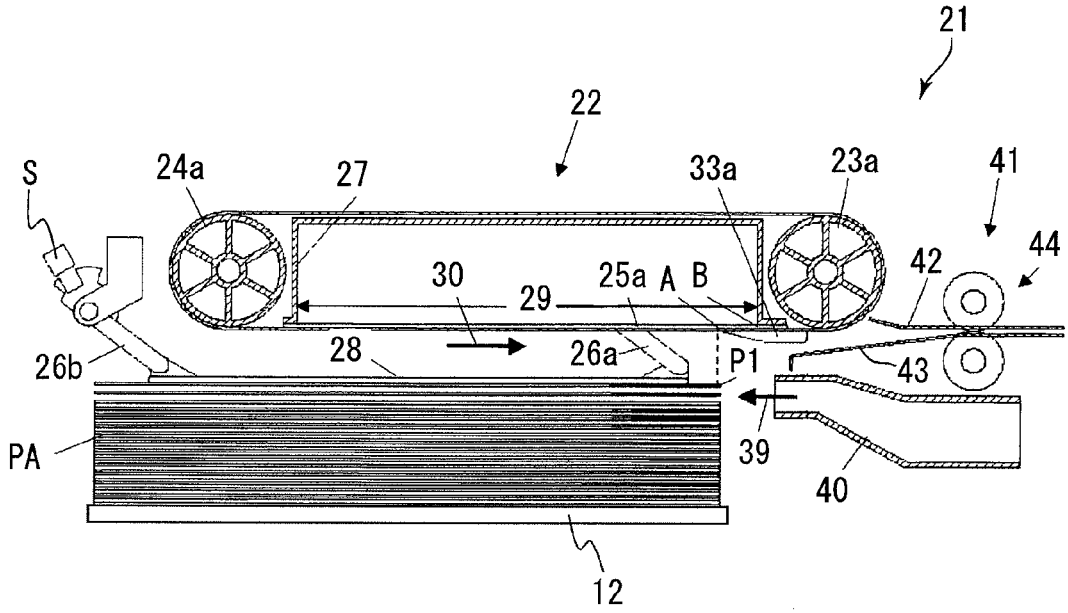
FIG. 2 is a first diagram illustrating a structure of the sheet feeding apparatus.

FIG. 2 illustrates a structure of the sheet feeding apparatus 21. In this context, the sheet feeding apparatus 21 includes an air blowing portion 40 which blows air in a direction indicated by the arrow 39 so as to blow upward and loosen upper sheets of a sheet bundle PA stacked on a raising and lowering tray 12 provided in the sheet storage portion 11. Further, the sheet feeding apparatus 21 includes a suction conveyance portion 22 which sucks and conveys the sheet thus blown upward, which suction conveyance portion 22 is arranged above the sheet bundle PA, and an intermediate conveyance portion 41 which conveys the sheet sucked and conveyed by the suction conveyance portion 22. The intermediate conveyance portion 41 includes intermediate guides 42 and 43 which guide the sheet and a pull-out roller pair 44 which conveys the sheet.

Figure 3:
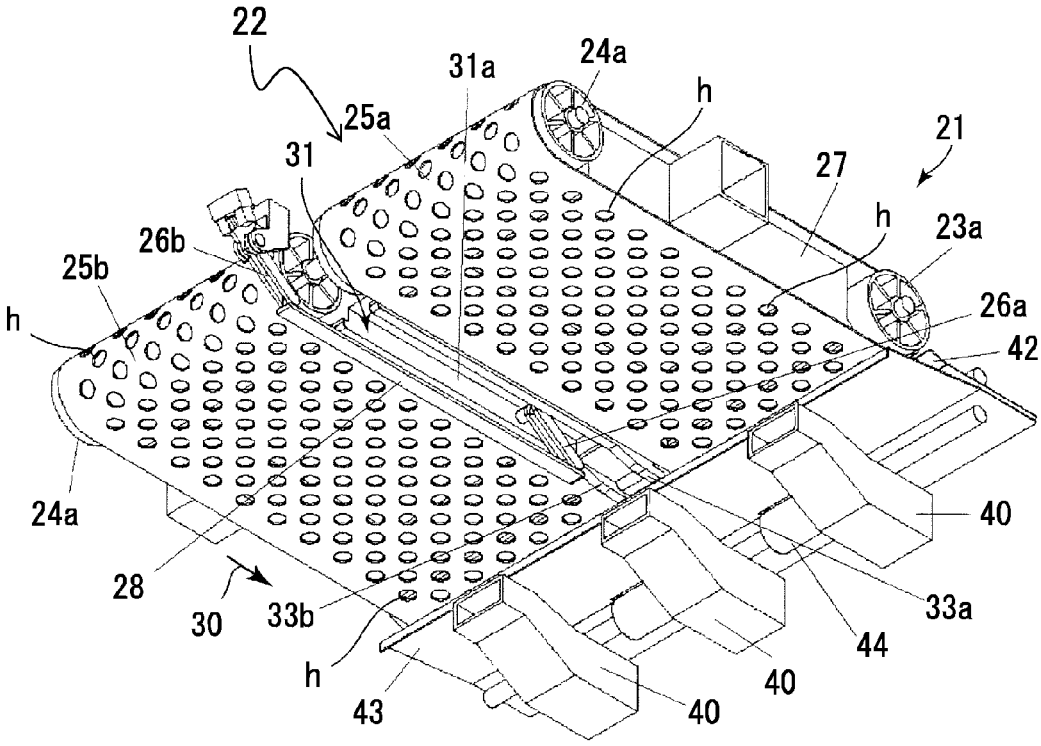
FIG. 3 is a second diagram illustrating the structure of the sheet feeding apparatus.

As illustrated in FIG. 3, the suction conveyance portion 22 includes two endless suction conveyer belts 25*a* and 25*b* which are arranged in parallel with each other and looped around pulleys 23*a* and 24*a*. The suction conveyer belts 25*a* and 25*b* are provided with numerous vents h, and travel in a direction indicated by the arrow 30. Further, the suction conveyance portion 22 includes a suction duct 27 which sucks the sheet P with a negative pressure from an opening portion thereof facing the sheet P, which is arranged inside the suction conveyer belts 25*a* and 25*b* arranged in parallel with each other and in parallel with the sheet feeding direction.

Still further, the suction conveyance portion 22 includes a sheet surface detecting unit which detects a level of an upper surface of a topmost sheet of the sheets supported by the tray. The sheet surface detecting unit includes a sheet surface detecting flag 28 serving as a sheet surface level detecting member, which abuts against the topmost sheet P1. In this context, the sheet surface detecting flag 28 is supported by links 26*a* and 26*b* between the two suction conveyer belts 25*a* and 25*b*, and is movable downward and in and out of a sheet suction surface of the suction conveyer belts 25*a* and 25*b*. Further, the sheet surface detecting unit includes a detection sensor S to be turned ON and OFF in association with the turning of the link 26*b*. Based on a signal generated by the detection sensor S according to a position in a height direction of the sheet surface detecting flag 28, a position of the topmost sheet is detected.

Further, the sheet surface detecting flag 28 is provided so as to be movable (storable) from a protruding position at which the sheet surface detecting flag 28 protrudes from the suction conveyer belts 25*a*, into a storage portion 31 provided in the suction duct 27 and 25*b* when the sheet surface detecting flag 28 is pressed by a sheet to be sucked. Note that, an opening portion 31*a* is provided in a lower surface of the storage portion 31. When the sheet is sucked and conveyed, as described below, the sheet surface detecting flag 28 protruding below the sheet suction surface of the suction conveyer belts 25*a* and 25*b* is pressed by the sheet lifted by blown air so as to be stored inside the storage portion serving as a retracted position through the opening portion 31*a*.

In the sheet feeding apparatus 21 structured as described above, at the time of feeding the sheet, first, as illustrated in FIG. 2, air is blown by the air blowing portions 40 in the direction indicated by the arrow 39 so as to blow upward the upper part of the sheet bundle PA stacked on the tray (not shown). Then, a level of the sheet surface (upper surface) of the topmost sheet P1 of the sheets thus blown upward is detected based on the position of the sheet surface detecting flag 28. Based on the detection results, the control device (not shown) performs raising/lowering control on the tray so that the level of the upper surface of the topmost sheet P1 falls within a level range in which the topmost sheet P1 can be sucked onto the suction conveyer belts 25*a* and 25*b*.

Figure 4A:
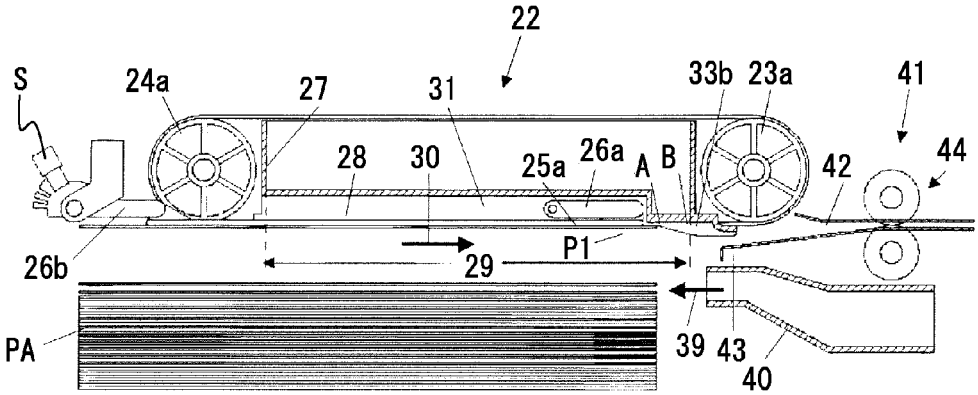
FIGS. 4A and 4B are first diagrams illustrating a sheet feeding operation of the sheet feeding apparatus.

Next, when the topmost sheet P1 is positioned within the level range in which the topmost sheet P1 can be sucked onto the suction conveyer belts 25*a* and 25*b* and a sheet feeding start signal is input, an inside of the suction duct 27 is brought into a negative-pressure state by a negative pressure providing unit (not shown). With this, the topmost sheet P1 at a predetermined sheet surface level is sucked onto a suction region corresponding to an opening portion 29 of the suction duct 27 of the suction conveyer belts 25*a* and 25*b*. In this way, the topmost sheet P1 is sucked onto the sheet suction surface formed of surfaces of the suction conveyer belts 25*a* and 25*b*. Note that, as a result of the suction of the topmost sheet P1, as illustrated in FIG. 4A, the sheet surface detecting flag is stored into the storage portion 31 by a negative pressure provided by the negative pressure providing unit and by the topmost sheet P1 moving upward.

Next, when, as described above, the suction conveyer belts 25*a* and 25*b* move in the direction indicated by the arrow 30 in a state in which the topmost sheet P1 is sucked onto the sheet suction surface, the topmost sheet P1 is conveyed integrally with the suction conveyer belts 25*a* and 25*b*. Then, when the topmost sheet P1 conveyed by the suction conveyer belts 25*a* and 25*b* is guided along the intermediate guides 42 and 43 and a leading edge of the topmost sheet P1 reaches the pull-out roller pair 44 of the intermediate conveyance portion 41, the negative-pressure state inside the suction duct 27, which is caused by the negative pressure providing unit, is cancelled. After that, rotation of the suction conveyer belts 25*a* and 25*b* is stopped, and the topmost sheet P1 is pulled out by the pull-out roller pair 44.

Then, the topmost sheet P1 thus pulled out by the pull-out roller pair 44 from the suction conveyance portion is conveyed to the image forming portion 102. Subsequently, by repeating the same operation, the sheets of the stacked sheet bundle PA are sequentially fed one by one to the image forming portion 102.

By the way, when the sheet is sucked onto and conveyed by the suction conveyer belts 25*a* and 25*b*, a sheet surface level of a part of the topmost sheet P1 against which the sheet surface detecting flag 28 is out of abutment is higher than that of a part thereof against which the sheet surface detecting flag 28 is in abutment, and hence enters a blown-upward state in which the part of the sheet is close to the suction conveyer belts 25*a* and 25*b*. When the topmost sheet P1 is sucked in such a blown-upward state, the part of the topmost sheet P1 against which the sheet surface detecting flag 28 is out of abutment and which is closer to the suction conveyer belts 25*a* and 25*b* reaches the suction surface earlier.

Figure 9A:
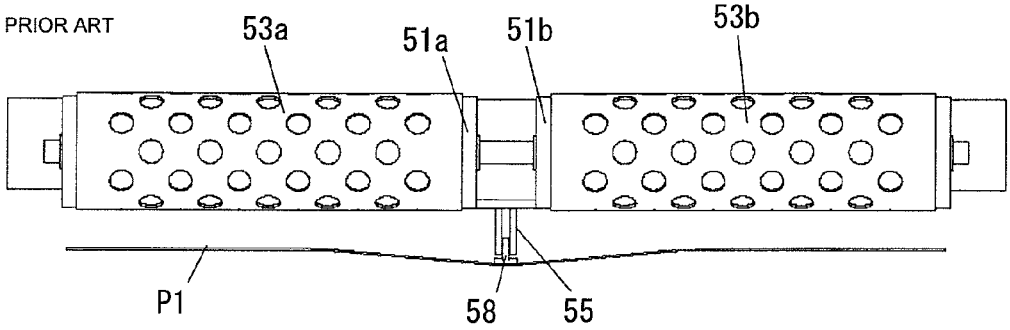
FIG. 9A PRIOR ART
FIGS. 9A, 9B and 9C are diagrams illustrating a state of a sheet when the sheet is sucked and conveyed by the conventional sheet feeding apparatus.
Figure 9B:
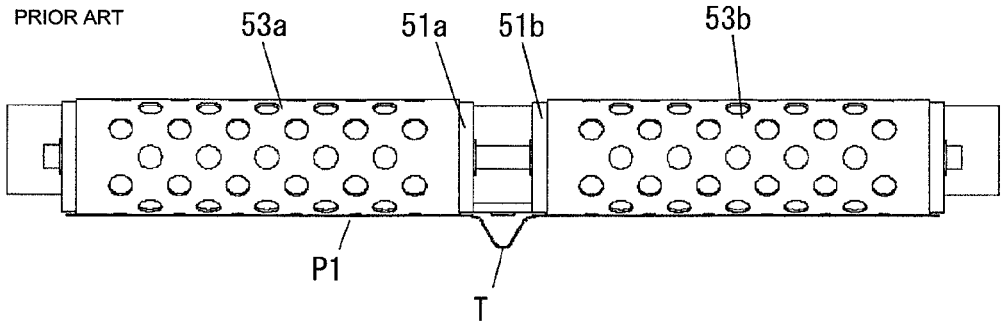
FIG. 9B PRIOR ART
Figure 9C:
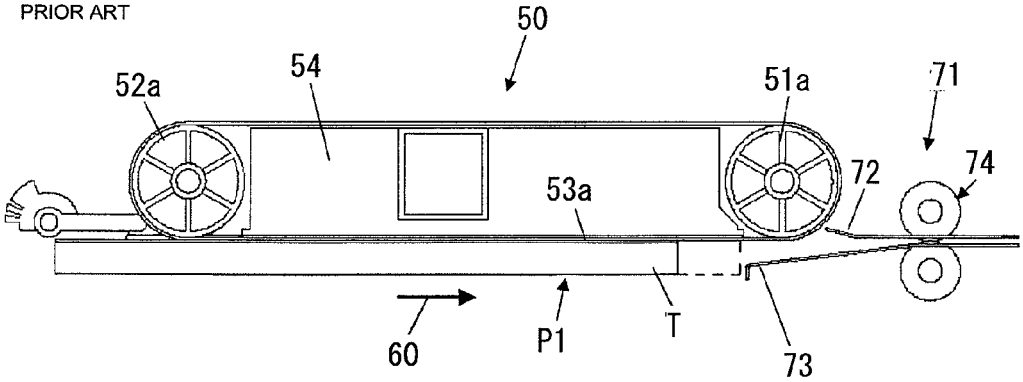
FIG. 9C PRIOR ART

As a result, the topmost sheet P1 is sucked onto the suction conveyer belts 25*a* and 25*b* in a state in which the part of the topmost sheet P1 against which the sheet surface detecting flag 28 is in abutment is deflected downward. In this case, when the sheet P to be sucked and conveyed is a sheet P having a low rigidity, such as a thin sheet, as described above with reference to FIGS. 9B and 9C, the sheet P may be deflected at the time of being sucked onto the suction conveyer belts.

In view of this, in this embodiment, as illustrated in FIG. 3, sheet guiding ribs 33*a* and 33*b* are provided on the suction ducts 27 along the opening portion 31*a*, specifically, at downstream end portions in a sheet conveying direction, the downstream end portions being positioned at both side edge portions of the opening portion 31*a* of the storage portion 31 in a width direction orthogonal to the sheet conveying direction. In other words, the sheet guiding ribs 33*a* and 33*b* are arranged in a pair as a sheet guiding member between the two suction conveyer belts 25*a* and 25*b*. Further, as illustrated in FIGS. 3 and 5B, the pair of sheet guiding ribs 33*a* and 33*b* are arranged so as to extend downstream from both edge portions of an opening surface of the opening portion 31*a*. Therefore, the pair of sheet guiding ribs 33*a* and 33*b* are arranged on left and right of the sheet surface detecting flag 28 in front view (as in FIG. 5B).

As illustrated in FIG. 2, the sheet guiding ribs 33*a* and 33*b* are provided so as to protrude downward with respect to the sheet suction surface of the suction conveyer belts 25*a* and 25*b*. Further, positions of upstream ends in the sheet conveying direction of the sheet guiding ribs 33*a* and 33*b* correspond to positions on the suction conveyer belts 25*a* and 25*b*, which correspond to a downstream end of the sheet in the sheet conveying direction. In other words, the positions of the upstream ends are on a downstream side of a sheet-suction start position A. More specifically, the positions of the upstream ends correspond to a downstream part of the suction region, in which the sheet can be sucked, of the sheet suction surface of the suction conveyer belts. Note that, the sheet-suction start position A is a position at which a position of a downstream end portion (leading edge) of the sheet is regulated by a sheet-leading edge regulating member (not shown).

Further, positions of downstream ends in the sheet conveying direction of the sheet guiding ribs 33*a* and 33*b* reach above the intermediate guide 43, which is a guide member provided in the intermediate conveyance portion 41. In other words, the sheet guiding ribs 33*a* and 33*b* are provided so as to range from a downstream side with respect to the sheet-suction start position A to a guide region of the intermediate guide 43 while protruding downward with respect to the sheet suction surface of the suction conveyer belts 25*a* and 25*b*.

Figure 4B:
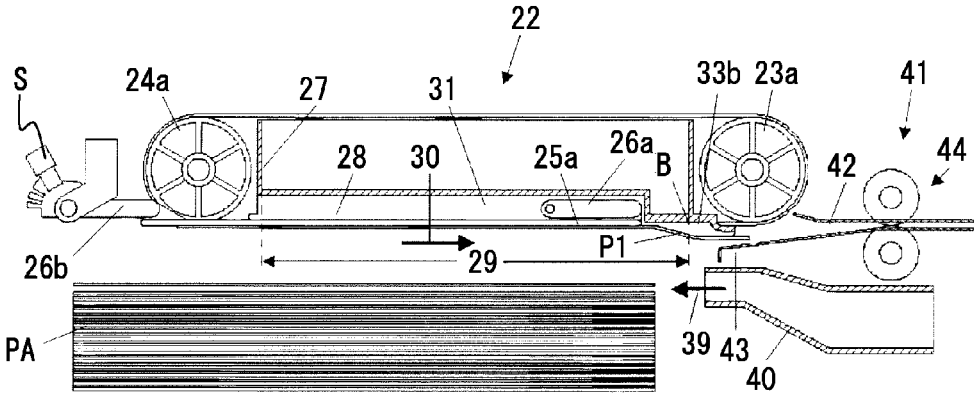

By providing such sheet guiding ribs 33*a* and 33*b*, when the topmost sheet P1 is sucked onto and conveyed by the suction conveyer belts 25*a* and 25*b*, the leading edge of the topmost sheet P1, which is a downstream end in the sheet conveying direction, first reaches the sheet guiding ribs 33*a* and 33*b* as illustrated in FIG. 4A. After that, as illustrated in FIG. 4B, the topmost sheet P1 passes the opening portion 29, which is the suction region of the suction duct 27, while climbing onto the sheet guiding ribs 33*a* and 33*b*, to thereby be spaced apart from the suction conveyer belts 25*a* and 25*b*.

Figure 5A:
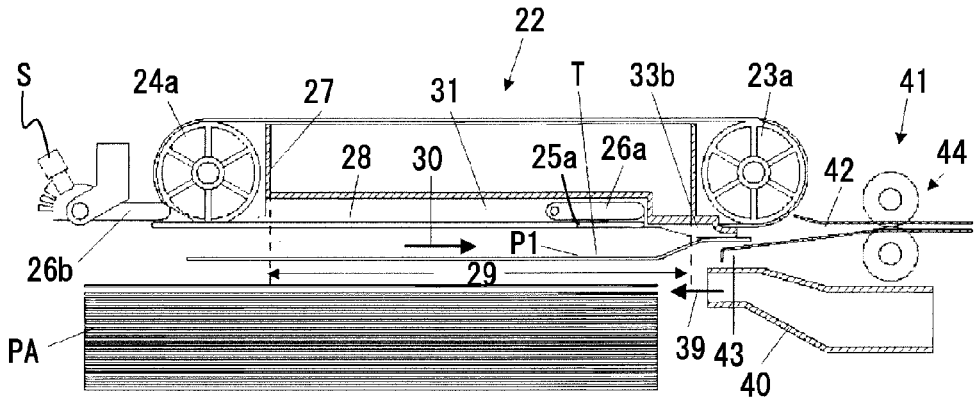
FIGS. 5A and 5B are second diagrams illustrating the sheet feeding operation of the sheet feeding apparatus.
Figure 5B:
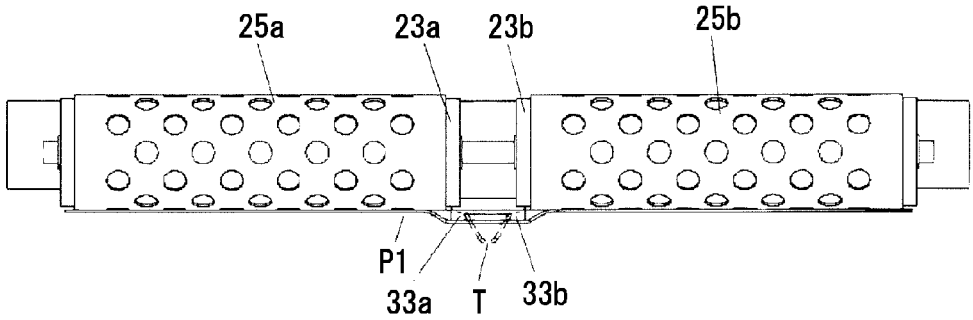

In this context, when the topmost sheet P1 passes the opening portion 29 while climbing onto the sheet guiding ribs 33*a* and 33*b* as described above, a deflection amount in the height direction of a deflected part T of the topmost sheet P1 decreases as illustrated in FIG. 5B, the deflected part being formed when the topmost sheet P1 is pressed by the sheet surface detecting flag 28 as illustrated in FIG. 5A. In this way, when the topmost sheet P1 deflected downward passes the sheet guiding ribs 33*a* and 33*b*, local deflection (deformation) formed at a part at which the topmost sheet P1 presses the sheet surface detecting flag 28 is distributed in a lateral direction (direction orthogonal to the sheet conveying direction). By distributing the local deflection of the topmost sheet P1 in this way, it is possible to prevent the topmost sheet P1 from coming into abutment against the intermediate guide 43. In addition, the topmost sheet P1 can be conveyed to the intermediate guide 43 without being wrinkled or jammed.

As described above, in this embodiment, during sheet conveyance, the topmost sheet P1 is conveyed in abutment against the sheet guiding ribs 33*a* and 33*b*. With this, the deflection formed when the topmost sheet P1 is sucked onto the suction conveyer belts 25*a* and 25*b* can be distributed and uniformed. As a result, the sheets can be conveyed without being wrinkled or jammed. In other words, when the topmost sheet P1 deflected downward during suction is conveyed, by bringing the deflected part T of the topmost sheet P1 into abutment against the sheet guiding ribs 33*a* and 33*b* so as to reduce the deflection amount of the deflected part T, the topmost sheet P1 can be conveyed without being wrinkled or jammed.

Figure 6:
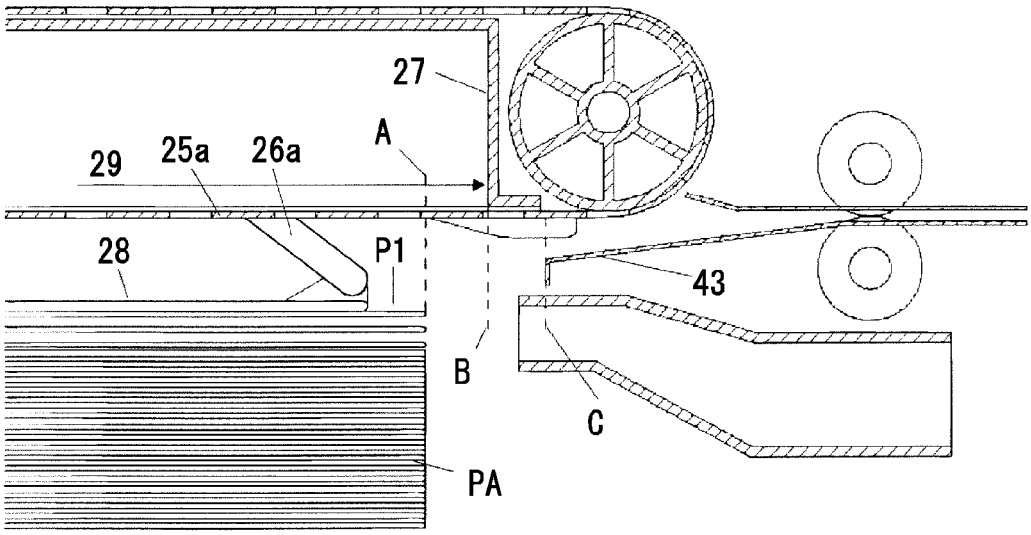
FIG. 6 is a diagram illustrating an installation position of a sheet guiding rib provided on the sheet feeding apparatus.
Figure 7A:
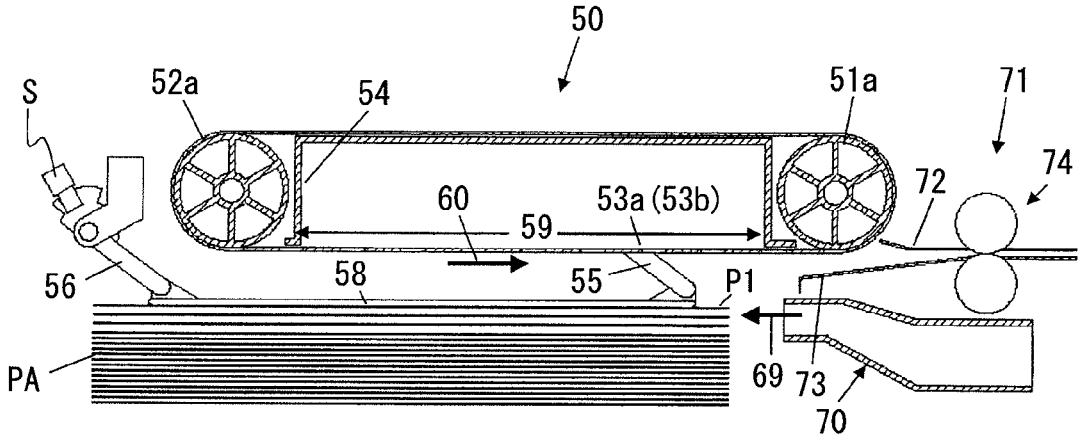
PRIOR ART FIG. 7A
FIGS. 7A and 7B are diagrams illustrating a structure of a conventional sheet feeding apparatus.
Figure 7B:
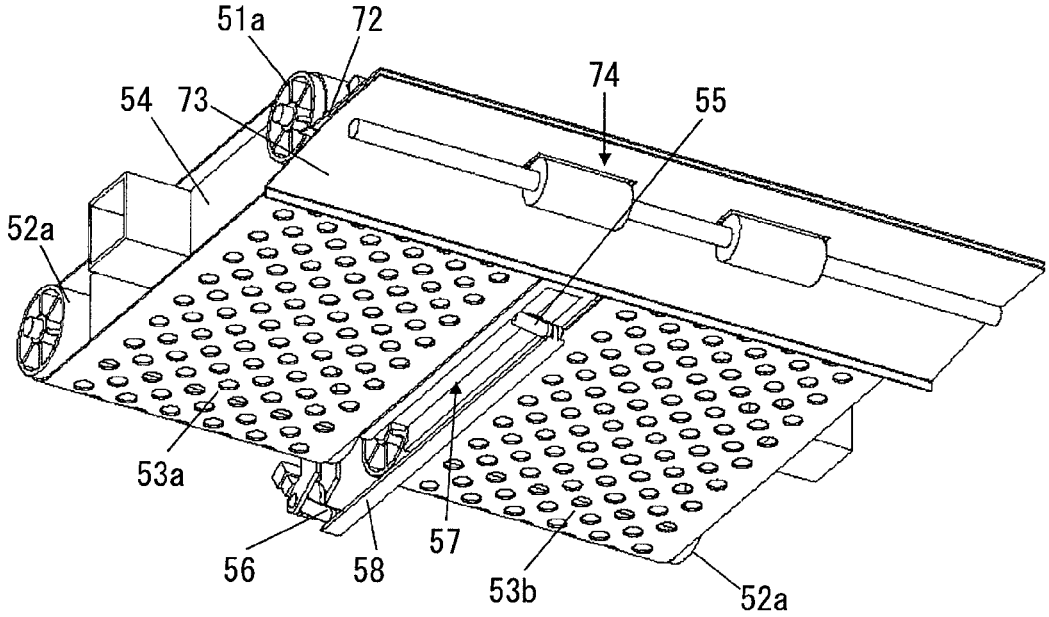
FIG. 7B PRIOR ART
Figure 8:
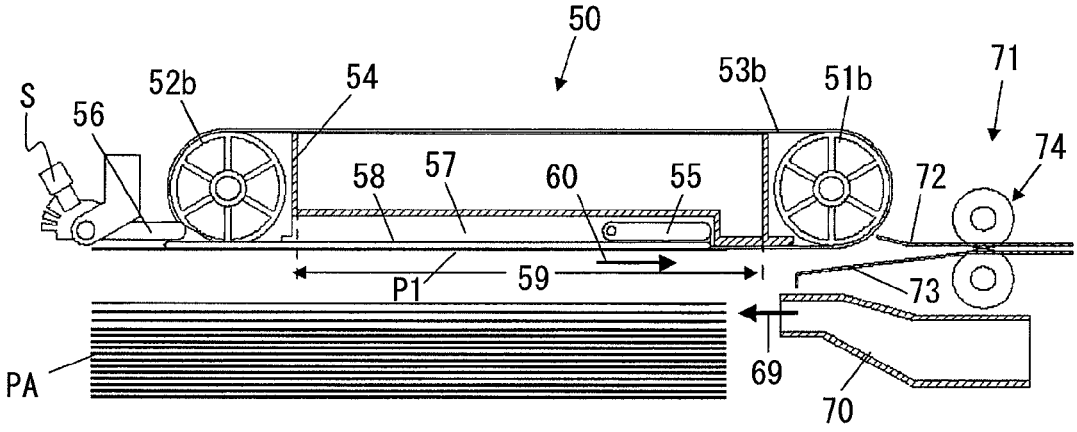
FIG. 8 PRIOR ART
FIG. 8 is a diagram illustrating a sheet feeding operation of the conventional sheet feeding apparatus.

In this embodiment, the sheet guiding ribs 33*a* and 33*b* are provided so as to range from the downstream side with respect to the sheet-suction start position A to the guide region of the intermediate guide 43. However, the present invention is not limited thereto, as long as the sheet guiding ribs 33*a* and 33*b* are provided at least in a region from a downstream side with respect to the suction region on which a suction force caused by the negative pressure of the suction ducts 27 is exerted, to an inlet of the intermediate guide 43 which guides a lower surface of the separated topmost sheet P1. That is, the sheet guiding ribs 33*a* and 33*b* may be provided in a region from a downstream side with respect to a downstream end portion B of the opening portion 29 of the suction duct 27 to the inlet C of the intermediate guide 43 as illustrated in FIG. 6.

Further, when a sheet suction force by the suction duct 27 is somewhat high, the sheet guiding ribs 33*a* and 33*b* can be further extended upstream with respect to the downstream end portion B of the opening portion 29 of the suction duct 27. Thus, the above-mentioned local deflection can be more reliably distributed and uniformed. Further, in this embodiment, the pair of sheet guiding ribs 33*a* and 33*b* are provided so as to extend downstream from both the edge portions of the opening portion 31*a* of the storage portion 31, in other words, from both sides of the sheet surface detecting flag 28. However, also when the sheet guiding rib is provided only on one side of the sheet surface detecting flag 28, in other words, only on one edge portion of the opening portion 31*a* of the storage portion 31, the advantage of distributing and uniforming the local deflection can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-026763, filed Feb. 10, 2011, which is hereby incorporated by reference herein in its entirety.

What is claimed is:

1. A sheet feeding apparatus, comprising:

a tray which supports sheets;

an air blowing portion which blows air to the sheets supported by the tray to blow the sheets upwards;

a plurality of suction conveyer belts which are arranged in parallel with each other and in parallel with a sheet conveying direction, and which draw, with negative pressure, a sheet lifted by the air blown by the air blowing portion and convey the sheet;

a sheet surface level detecting member which is arranged between the plurality of suction conveyer belts so as to come into abutment against a topmost sheet of the sheets blown upwards by the air blowing portion, the sheet surface level detecting member being retractably moved into a storage portion between the plurality of suction conveyer belts through an opening portion provided on the storage portion; and a pair of sheet guiding ribs which is provided on the storage portion downstream in the sheet conveying direction of a sheet suction region of the plurality of suction conveyer belts, and arranged so as to extend downstream from both edge portions of the opening portion in a width direction orthogonal to the sheet conveying direction at positions corresponding to both sides of the sheet surface level detecting member; and a guide member which is provided downstream of the sheet suction region of a sheet suction surface of the plurality of suction conveyer belts and which guides a lower surface of a sheet separated from the plurality of suction conveyer belts after being sucked and conveyed by the plurality of suction conveyer belts, wherein the sheet guiding ribs are provided in a region ranging from a position downstream of the sheet suction region of the sheet suction surface in the sheet conveying direction and upstream of the guide member in the sheet conveying direction to above the guide member.

2. A sheet feeding apparatus according to claim 1, wherein the storage portion stores the sheet surface level detecting member, and the opening portion is provided in a lower part of the storage portion.

3. An image forming apparatus, comprising:

a sheet feeding apparatus; and an image forming portion which forms an image on a sheet fed by the sheet feeding apparatus, the sheet feeding apparatus including:

a tray which supports the sheets;

an air blowing portion which blows air to the sheets supported by the tray to blow the sheets upwards;

a plurality of suction conveyer belts which are arranged in parallel with each other and in parallel with a sheet conveying direction, and which suck, with a negative pressure, a sheet lifted by the air blown by the air blowing portion and convey the sheet;

a sheet surface level detecting member which is arranged between the plurality of suction conveyer belts so as to come into abutment against a topmost sheet of the sheets blown upwards by the air blowing portion, the sheet surface level detecting member being retractably moved into a storage portion between the plurality of suction conveyer belts through an opening portion provided on the storage portion; and a pair of sheet guiding ribs which is provided on the storage portion downstream in the sheet conveying direction of a sheet suction region of the plurality of suction conveyer belts, and arranged so as to extend downstream from both edge portions of the opening portion in a width direction orthogonal to the sheet conveying direction at positions corresponding to both sides of the sheet surface level detecting member; and a guide member which is provided downstream of the sheet suction region of a sheet suction surface of the plurality of suction conveyer belts and which guides a lower surface of a sheet separated from the plurality of suction conveyer belts after being sucked and conveyed by the plurality of suction conveyer belts, wherein the sheet guiding ribs are provided in a region ranging from a position downstream of the sheet suction region of the sheet suction surface in the sheet conveying direction and upstream of the guide member in the sheet conveying direction to above the guide member.

4. An image forming apparatus according to claim 3, wherein the storage portion stores the sheet surface level detecting member, and the opening portion is provided in a lower part of the storage portion.

* * * * *